US005505995A

United States Patent [19]

Leonard

[11] Patent Number: 5,505,995

[45] Date of Patent: Apr. 9, 1996

[54] METHOD AND APPARATUS FOR COATING SUBSTRATES USING AN AIR KNIFE

[75] Inventor: William K. Leonard, Troy Township, St. Croix County, Wis.

[73] Assignee: Minnesota Mining and Manufacturing Company, St. Paul, Minn.

[21] Appl. No.: 382,689

[22] Filed: Feb. 2, 1995

[51] Int. Cl.[6] ..... B05D 3/04; B05C 11/06

[52] U.S. Cl. ..... 427/348; 427/350; 427/402; 427/420; 118/63; 118/411; 118/324; 118/DIG. 4

[58] Field of Search ..... 427/350, 348, 427/356, 402, 420; 118/63, 410, 411, 324, DIG. 4

[56] References Cited

U.S. PATENT DOCUMENTS

| | | | |
|---|---|---|---|
| Re. 24,906 | 12/1960 | Ulrich . | |
| 2,135,406 | 11/1938 | MacDonald . | |
| 2,139,628 | 12/1938 | Terry . | |
| 2,761,419 | 9/1956 | Mercier et al. . | |
| 2,761,791 | 9/1956 | Russell . | |
| 3,005,440 | 10/1961 | Padday . | |
| 3,508,947 | 4/1970 | Hughes . | |
| 3,632,378 | 1/1972 | Busch . | |
| 3,632,403 | 1/1972 | Greiller . | |
| 3,916,077 | 10/1975 | Damrau . | |
| 4,093,757 | 6/1978 | Barrand et al. . | |
| 4,348,432 | 9/1982 | Huang . | |
| 4,472,480 | 9/1984 | Olson . | |
| 4,504,645 | 3/1985 | Melancon . | |
| 4,748,043 | 5/1988 | Seaver et al. . | |
| 4,978,731 | 12/1990 | Melancon et al. . | |
| 5,234,500 | 8/1993 | Korokeyi . | |
| 5,318,804 | 6/1994 | Yoshida | 427/356 |
| 5,332,797 | 7/1994 | Kessel et al. . | |

FOREIGN PATENT DOCUMENTS

| | | | |
|---|---|---|---|
| 0562975A2 | 9/1993 | European Pat. Off. . | |
| 59-22684 | 2/1984 | Japan | 118/63 |
| 2-173080 | 7/1990 | Japan . | |
| 2-207870 | 8/1990 | Japan . | |

*Primary Examiner*—Shrive Beck
*Assistant Examiner*—Katherine A. Bareford
*Attorney, Agent, or Firm*—Gary L. Griswold; Walter N. Kirn; Charles D. Levine

[57] ABSTRACT

The method of coating a substrate with plurality of layers of coatings includes moving the substrate along a path through the coating station. A composite layer is formed of first and second coating fluids. The substrate contacts the flowing composite layer to interpose the first coating fluid between the substrate and the second coating fluid. The composite layer is doctored with a gas from a gas knife to remove some portion of the composite layer from the substrate.

24 Claims, 2 Drawing Sheets

METHOD AND APPARATUS FOR COATING SUBSTRATES USING AN AIR KNIFE

TECHNICAL FIELD

This invention relates to preparing single and multilayer wet coatings of 0.01 to 1000 microns by simultaneous coating in one step. In particular, the invention relates to improvements on the method and apparatus for air knife coating a substrate. This technology is particularly useful for the paper coating and water-based coating industries.

BACKGROUND OF THE INVENTION

Often, layers of differing compositions must be applied to a substrate. It is common to apply a primer coating under a paint to improve the anchorage. In the manufacture of photographic film, as many as twelve layers of differing compositions must be applied in a distinct layered relationship with close tolerances on uniformity. The use of sequential coating operations can produce a plurality of distinct superposed layers on a substrate. However, this is costly and time consuming and may require a large investment in the sequential coating and drying stations.

Methods of applying simultaneous, multilayer coatings are discussed in the book: Cohen, E. D. and Gutoff, E. B., Editors, 1992, *Modern Coating and Drying Technology*, chapter 4, VCH Publishers, New York. Slot or extrusion, premetered die coaters are disclosed in U.S. Pat. Nos. 2,761,419 and 2,761,791 and many improvements have been developed over the years. With these coaters, the surface of the web to be coated is brought into contact with or in close proximity to the die and a plurality of superposed layers is deposited. Each coating composition is metered to the coating die which deposits them as layers on the web. However, the uniformity of the gap to the web limits the quality of the coatings, and the maximum speed of operation is limited.

Another method of simultaneous, multilayer coating is curtain coating. U.S. Pat. No. 3,508,947 teaches the use of this method with the coating of photographic elements. Curtain coating uses a free falling vertical curtain of liquid which impinges upon the web traversing the coating station. This patent teaches a method of forming the curtain from a plurality of distinct layers to accomplish a multilayer coating on the web. The gap between the coating die and the web is much greater than previous methods and the speeds of application are substantially greater. However, this method has set caliper and speed limitations.

A limitation of curtain coating is that for any formulation there is a minimum flow rate below which a stable curtain can not be maintained. This prevents coating thinly at slow and moderate speeds. Since the slide and the curtain simultaneous multilayer methods were first introduced, many refinements have been invented. However, there is still the need for improved low speed and high speed simultaneous layer method of coating.

The technology of single layer air knife coating is summarized in Chapter II of the book *Pulp and Paper Manufacture, Volume 8; Coating, Converting, and Specialty Processes*, Michael Kouris, Technical Editor, 3rd edition, 1990, published by The Joint Textbook Committee of the Paper Industry, TAPPI and CPPA, Atlanta, Ga. Additional description is in chapter 5 of the book by Cohen and Gutoff. Air knife coating is characterized by the application of an excess of a single coating fluid composition to a web followed by the removal of a portion of this fluid by a gas jet issuing from a nozzle. There is a low speed region of application where low gas pressure is used in the nozzle. Excess coating is forced counter to the web direction of motion and a controlled amount passes through the gas jet on the web surface. This technology has been employed by the photographic industry. There is a high speed region of operation employed by the paper coating industry and in molten metal coating by hot dip steel strip manufacturers. In this case, the gas pressures and web speeds are high and the excess fluid is often atomized by the jet. Both the low and high speed techniques are known only as single layer coating methods using a single coating fluid composition, and they have been practiced for more than fifty years. Both technologies have used coating applicator dies to apply the excess of coating to the substrate before passing the gas jet. These dies are used to crudely apply the excess, and they are used to apply only a single coating fluid composition.

The conventional air knife coating method suffers in range of lo applicability primarily because it coats only one layer at a time, and because it has minimum coating caliper limitations. To produce thin dried coatings, the mass of solids passing through the gas jet per unit of substrate area and left on the substrate must be low. The gas velocity, percent solids, and coating viscosity are the dominant variables controlling this coating weight. Thinner coatings may be obtained by reducing the percent solids, reducing the viscosity, or increasing the jet velocity. There will always be economic and physical limitations on all of these. If the percent solids is reduced, more diluent liquid must be added, increasing both cost and drying time. Reducing the viscosity requires changing the formulation and may result in unwanted flow of the coating after passing the jet and before drying or solidification. Jet velocity increases are limited by numerous practical considerations including the cost and complexity of exceeding the speed of sound with the jet, the mess created by misting the excess coating fluid, and the noise of a high velocity jet.

There is a need for a more versatile multilayer coating method and a multiple layer air knife coater. There is also a need for an improved air knife coater for applying a single dried layer of a coating from a composite layer fluid. And there is a need for a new method which coats thin wet coatings at low speeds (25 microns at 10 m/min web speeds) as well as at high speeds.

SUMMARY OF THE INVENTION

The method of coating a substrate with plurality of layers of coatings includes moving the substrate along a path through the coating station. A composite layer is formed and has at least one first coating fluid and a miscible second coating fluid. The substrate contacts the flowing composite layer to interpose the first coating fluid between the substrate and the second coating fluid. The composite layer is doctored with a gas to remove some portion of the composite layer from the substrate.

A plurality of first coating fluids can be used. When a plurality of first coating fluids are used, at least two of these first coating fluids can be immiscible. The first coating fluid can be latex, and the second coating fluid can be water. Alternatively, both coating fluids can be latexes having different compositions or percent solids or both.

A multilayer slide coater, a curtain coater, a jet coater, a bead coater, or an extrusion die coater can be used to apply the coating fluid to the substrate, or the layers of the first and second coating fluids can be. formed sequentially.

The substrate can be moved through the coating station at speeds of up to 1000 m/min.

Also, the composite layer can be first placed on a transfer surface before being transferred to the substrate.

The apparatus includes a die for ejecting a first coating fluid. The die can be a multilayer coating die.

DETAILED DESCRIPTION

The co-pending U.S. patent application Ser. No. 08/382,962, entitled "*Apparatus of Applying Thin Fluid Coatings*", in the name of William K. Leonard et. al. discloses a method of applying a liquid coating by creating a two-layer composite of coating fluid and a carrier fluid which is applied to a substrate as a simultaneous, two-layer composition layer on the substrate followed by the removal of the carrier fluid leaving behind the coating fluid. It is the objective of this invention to coat a plurality of simultaneously applied coating fluids on a substrate at a coating station by a method of moving the substrate through the coating station; forming a composite layer of a plurality of separate flowing layers of fluids of different but miscible compositions; depositing a composite layer on the substrate surface as it traverses through the coating station; then removing a portion of the composite by the doctoring action of a gas jet (air knife) which extends traversely across the path of the substrate. The substrates may be continuous webs running at speeds of 1 to 1000 m/min through the coating station, or they may be discrete sheets or discrete rigid piece parts or an array of pieces or pads transported through the coating station.

The respective layers can have differing compositions, and have wide variation in viscosity, surface tension, and thickness ratios. The coating fluids preferably have a combination of surface tension and viscosity so that they will not dewet from the substrate surface after being spread over the surface within the time of transport through the coating station. Examples of coating fluids coatable by this method are monomers, oligomers, solutions of dissolved solids, solid-liquid dispersions, liquid mixtures, emulsions, and latexes.

Figure 1:
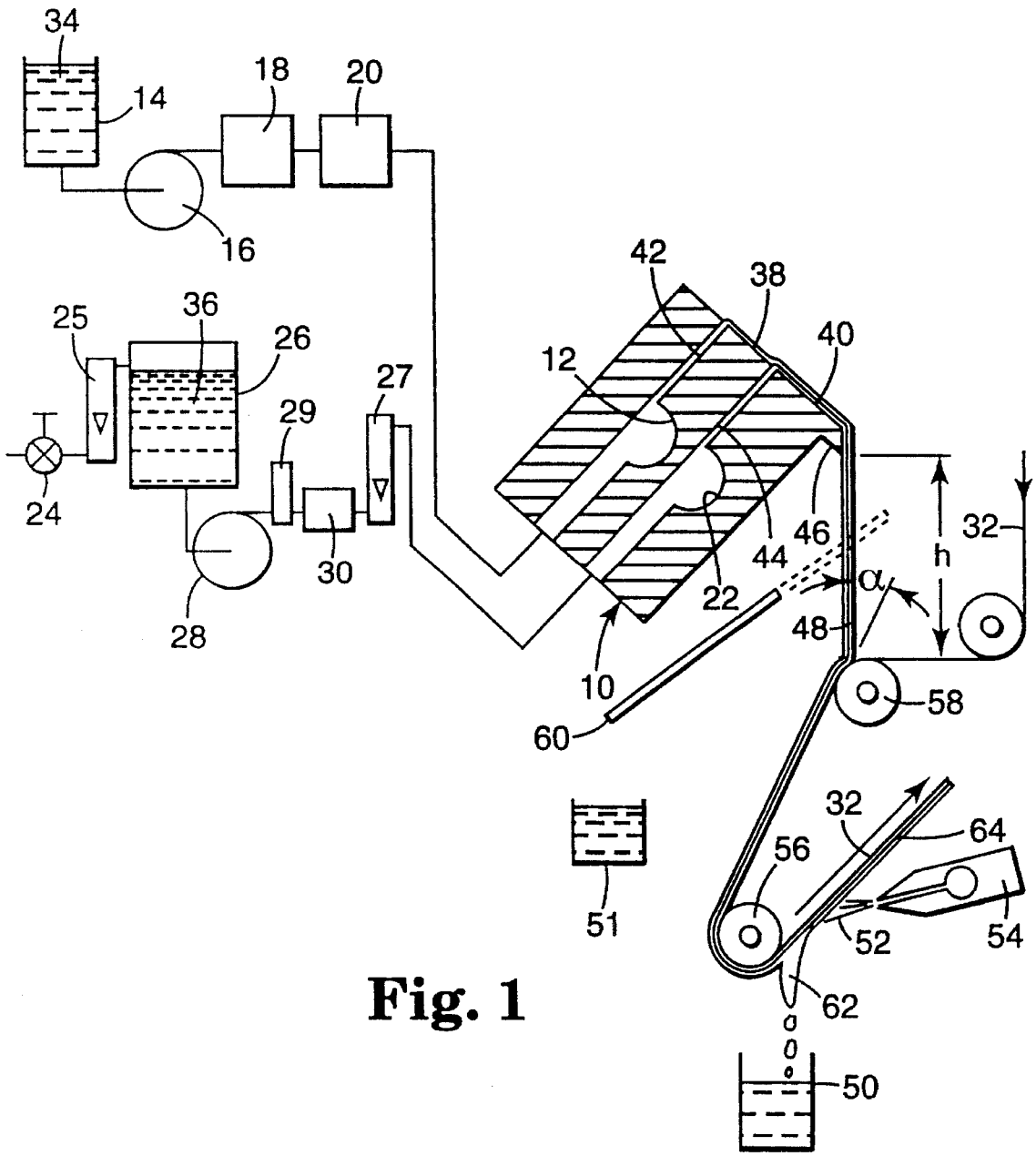
FIG. 1 is a schematic view of a coating apparatus according to the present invention.

The method of coating is best understood by referring to FIG. 1 which illustrates a coating station including a preferred apparatus of this invention. The coating die 10 is commonly known in the photographic industry as a slide curtain coater. A first coating fluid 34 of a first composition is pumped at a precisely controlled rate from a tank 14 by a precision metering pump 16 through a filter 18 and a bubble trap 20 to the coating die 10. The web 32 passes into the coating station and past the die 10 which is mounted transverse to the web. A second coating fluid 36 of a second composition passes through a throttling valve 24 and a flow meter 25 to a vacuum degassing vessel 26, The flow rate is measured leaving the vacuum degassing vessel with another flow meter 27. Both flow meters can be rotometers. The flow from the vessel 26 is pumped by a progressive cavity pump 28. From the pump 28, the second coating fluid 36 flows through a sealed surge tank 29, through a fine filter 30, through the discharge flow meter 27 and into the coating die 10. Internal cavities 12 and 22 distribute the flow of coating fluids across the width of this two-layer slide curtain coating die 10 so that they are distributed to the die faces 38 and 40 through distribution slots 42 and 44. The first and second fluids are miscible, but they have different compositions. These fluids may have identical constituents and vary only in the concentrations of the individual components, or these fluids may have different constituents. If the fluids are solutions, dispersions, or emulsions, the major liquid components may be identical or different.

The first coating fluid 34 flows onto the top of the second coating fluid 36 at the exit of slot 44, and then flows in a layered relationship with and on top of the second fluid down the slide incline to the die lip 46 as a composite layer. From the lip, the composite liquid film falls in a curtain 48 under the influence of gravity to contact the web 32. The web 32 is moved through the coating station and past the transverse coating die 10 so that when the composite layer curtain contacts the web the first coating fluid is placed adjacent to the web surface and is interposed between the web and the second coating fluid. The first coating fluid 34 will have intimate contact with the web 32 and the second coating fluid 36 will not. The individual layers remain distinct and unmixed. The curtain applicator die here is used to apply an excess of the second coating fluid 36 to the substrate. Therefore, the composite layer is also said to be in excess. The amount of excess is controlled by the metering of the second fluid 36. Some portion of this will be subsequently removed by the air knife doctor as described below.

FIG. 1 also shows an interceptor baffle 60 which may be moved to intercept the curtain before it impinges the substrate 32. This may be engaged to facilitate start-up and shut-down procedures and generally allows stopping the web coating operation without stopping the web or the coating fluid flows. When the baffle 60 is engaged, as shown by the broken lines, fluid will flow down it and into a catch pan 51.

The combined wet thickness of the composite layer of coating fluids deposited on the moving substrate will be related to the thickness of the multilayer curtain just before impingement upon the substrate. Faster substrate speeds will produce thinner coatings. High substrate speeds are possible as long as the kinetic energy of the impinging curtain is sufficient to displace the air on the surface of the substrate in a sufficiently uniform and stable manner. If the impingement speed is greater than the substrate speed, the wet thickness of the layers on the substrate will be greater than the curtain just before impingement. Depending on many factors, the impact of the curtain may cause a "fluid heel" to form on the upstream side of the substrate at the impingement point. When this becomes large, the quality of the layer coating may suffer or mixing may occur. Factors that influence this are the flow properties of the layers, the surface and interfacial tension of the layers, the angle of impact with the substrate, external body forces, and external pressure gradients. Layer flow rates, substrate speed, coating die distance from the substrate, and the angle of impingement are the primary variables the coater operator may change to stabilize deposition. Also, there are many refinements of curtain coating techniques. All of these may benefit the use of the slide curtain die as an applicator of excess of the composite coating fluid layer before the air knife 54.

After the substrate passes the slide curtain die and the composite layer has been applied in excess, the substrate passes the gas jet nozzle which is also known as an air knife 54. This can be designed according the teachings of U.S. Pat. No. 2,135,406. This nozzle commonly uses air as the functioning gas.

The jet 52 issuing from the air knife 54 either prevents some portion of the composite layer of coating fluids on the web approaching the air knife 54 from passing beyond the knife 54 position or it blows some portion of the coating fluids off of the substrate as a mist depending upon the jet's volume and velocity. It is preferred that the substrate pass upwardly past the jet so that gravity helps to pull the excess down and away from the jet impingement point. The back flow of the excess builds a thick layer of the second coating fluid 62 below the jet 52 which is very nonuniform and whose motion is turbulent or chaotic. Unexpectedly, it has been found that despite this, it is possible to produce a two layer composite coating 64 on the downweb side of the air knife 54 even though the first and second coating fluids are miscible. (Miscible fluids if placed in a beaker together and stirred would merge and form a single fluid of uniform composition.) In addition and also surprisingly, it has been found that the air jet 52 may be adjusted so that a portion of only the second fluid 36 is removed with the first fluid 34 left substantially undisturbed and intact. This is more easily accomplished when the first coating fluid is more viscous than the second, such as when the first coating fluid viscosity is ten and even one hundred times higher than the viscosity of the second coating fluid. The two layer composite coating 64 remains on the substrate after passing the air knife. The excess coating fluid 62 drains and falls from the web into pan 50. This excess may be discarded or reused if suitable.

After passing the air knife 54, the composite layer 64 may be dried, gel led, or cured as needed by the particular application. This would be followed by roll winding, sheeting, or further processing steps. Mechanical, vibrational, or magnetic smoothing of the wet composite coating could also be used. As shown, a multilayer slide curtain coater die 10 is used to apply the excess. Other simultaneous multilayer coating devices could be used including slide, bead, extrusion, and jet die devices. The composite layer of excess material may also be built up by a sequence of single layers deposited on the web surface without an intervening excess removal or drying step.

Figure 2:
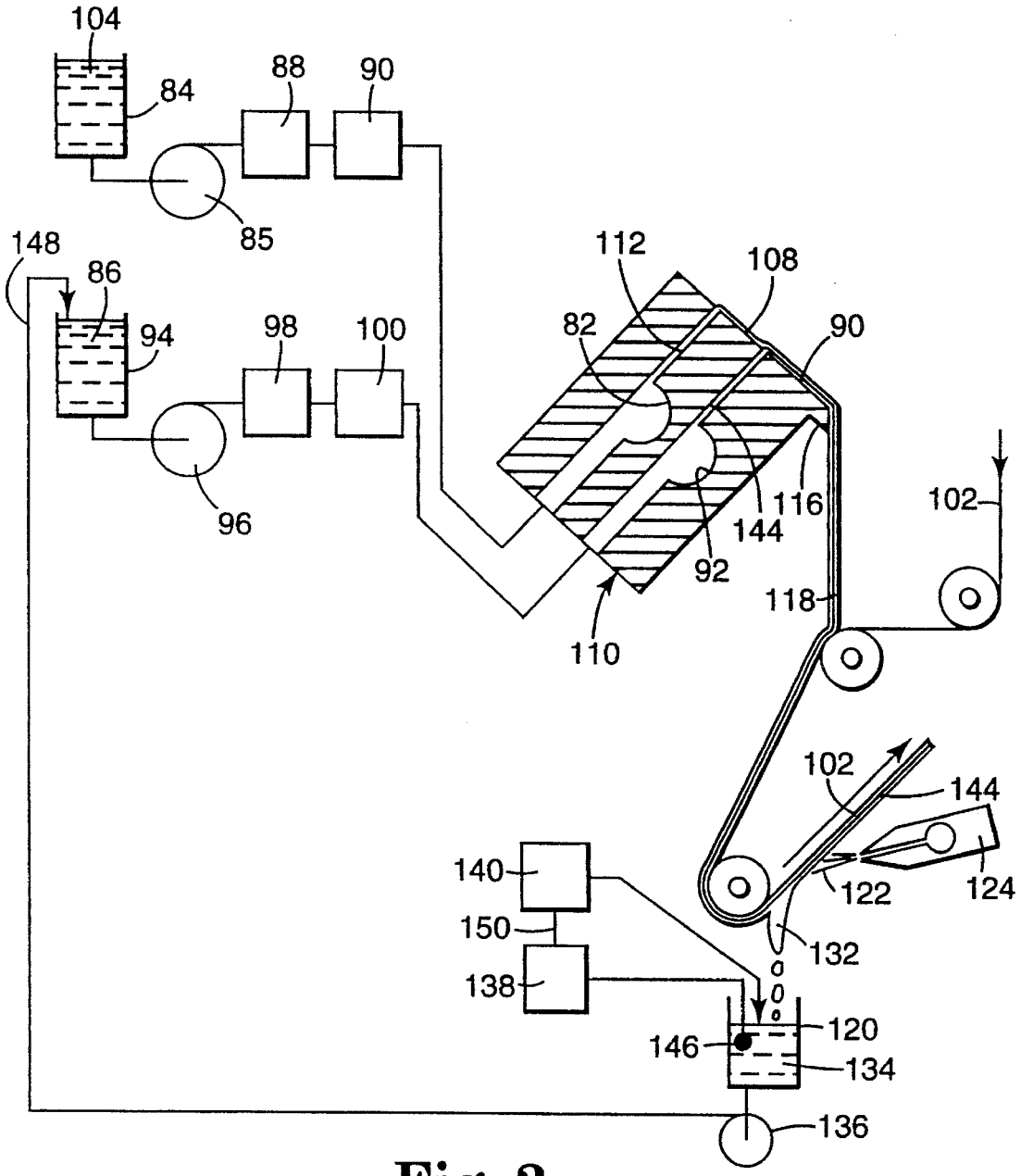
FIG. 2 is a schematic view of another embodiment of the coating apparatus according to the present invention.

This simultaneous multilayer air knife coating technique is especially useful in producing solid coatings on substrates from latexes. Often, the commonly-known single layer air knife coating method has problems when coating latex. Thin coating with the conventional single layer method may require jet velocities that produce misting or foaming which create quality and waste problems. This may be avoided using the multilayer approach. Thin dried coatings of one latex may be applied by using two different percent solids compositions of the same latex as shown in FIG. 2. The advantage is that most of the solids may be precisely metered with a high solids first coating fluid while the low solids content second fluid facilitates the deposition of the first fluid on the web before passing the air knife. Additionally, after passing the air knife, the composite layer coating of a high viscosity first fluid layer beneath a low viscosity second fluid layer can speed drying and promote dried coating surface smoothness.

In FIG. 2, a high-solids latex first coating fluid 104 is pumped at a precisely controlled rate from a tank 84 by a precision metering pump 85 through a filter 88 and a bubble trap 90 to the coating die 110. The continuous web 102 passes into the coating station and past the die 110 which is mounted transverse to the web. A second coating fluid 86 can be the first coating fluid 104 diluted with conditioned water to form a low solids composition second latex 86. The water is conditioned with whatever salts, pH adjusters, buffering agents, and surfactants are necessary to dilute without causing coagulation of the latex. The second coating fluid 86 is supplied from a tank 94 by a precision metering pump 6 through a filter 98 and a bubble trap 100 to the coating die 110. As with the apparatus in FIG. 1, cavities 82 and 92, slots 112 and 144, and faces 108 and 90 function to create a layered composite falling curtain 118 of the first 104 and second 86 coating fluids. These first and second coating fluids are miscible, and differ primarily in percent solids. Since latex viscosity is usually a very strongly function of percent solids, the viscosities of the first and second fluids may differ by a factor of 2 to 1000 or more depending on the viscosity of the first from which the second was produced by dilution.

The substrate is moved through the coating station and past the transverse coating die so that when the composite layer curtain 118 contacts the web, the first coating fluid 104 is placed adjacent to the web surface and is interposed between the web 102 and the second fluid 86. The first coating fluid 104 will have intimate contact with the web and the second coating fluid 86 will not.

The flow rate of the first coating fluid 104 is initially chosen to equal that which is necessary to achieve the desired dried coating weight on the web 102 at the given web speed. If this flow is sufficient to form a continuous curtain from the die lip 116 without the use of the second fluid and if the curtain can be deposited on the web without air entrainment or objectionable patterns, then this invention is not needed and conventional curtain coating may be used produce the desired coating weight. Unfortunately, this is not the case at low web speeds or at very low flow rates of the first coating fluid 104.

To produce the desired coating deposit on the web, the second coating fluid 86 is used to produce a composite curtain 118 flow that is stable and flows at a rate that deposits on the web without air entrainment and patterns. The second coating fluid 86 flows at a flow rate which differs from that of the first coating fluid 104. In preferred uses, this second coating fluid flow rate is higher than that of the first coating fluid, although there are some situations in which the second coating fluid flow rate is lower. This composite layer 118 constitutes an excess of the composite that must be doctored with the air knife 124 to remove the excess. The removal of the excess may be controlled by changing the air knife 124 position, gas flow rate, and gas velocity. It is preferred that the viscosity ratio of the second 86 to the first 104 coating fluid is 0.1 or lower. It is possible to adjust the operation of the air knife 124 to remove the excess of the second fluid and leave behind a composite layer 144 of the first fluid and enough of the second to achieve the desired dry coating weight on the web after drying. After initial trials, it may be necessary to adjust the flow rate of the first fluid to obtain the exact desired dry coating weight of the composite layer 144. The adjustment is needed to compensate for the solids mass added to the composite layer 144 by the layer of the second fluid 86 left behind after the air knife has removed the excess. In the extreme, the second coating fluid could be nearly 100% water. Here the final dried coating could be achieved by drying the composite layer applied by the curtain die without using air knife doctoring. However, the total heat load required would be large compared to that when a portion of excess water is removed by using the air knife 124. The use of the air knife is therefore highly desirable.

Producing a coating of the composite layer 144 where the first fluid 104, latex, is next to the web and the second fluid, water, is stratified on top of the first may be useful in enhancing the quality of the coated product and improving the drying rate.

Below the air knife 124 in FIG. 2, a pan 120 catches the excess fluid blown off or held back by the jet 122. This fluid will be primarily the second fluid 86 with some small amount of contamination from the first fluid 104. Contamination comes from diffusion of material across the interface of the layers and from the first fluid 104 in the heavy edge bead (not shown) at the ends of the curtain in the traverse web direction. The air knife 124 normally removes the edge bead and mixes it with the excess fluid 132 held back by the jet 122. The composition of the fluid 134 in the pan may differ from that in the supply tank 94 because of this and other factors such as evaporation. A recycle pump 136 conveys fluid 134 back to the supply tank 94 through the process pipe 148 for muse. The percent solids, viscosity, pH, surface tension, and any other critical properties of the fluid in the pan can be monitored by a monitor 138 connected to a sensor 146 which samples the fluid 134. The monitor 138 sends control signals through a wire 150 to the control module 140 which contains additional pumps to supply water and conditioning agents (not shown) to the pan 120 as needed to adjust the fluid 134 to a composition as nearly identical to the fluid 86 in supply tank 94.

An additional variation of this invention would include forming a first coating fluid layer as a composite of a plurality of coating fluid layers. In this manner, a multilayer coating of more than two layers can be applied to the web. When the first coating fluid is a plurality of layers, the layer adjacent to the second coating fluid should be miscible with the second coating fluid.

Also, these systems need not use a die at all. For example, a fluid trough which terminates in an overflow weir to create a curtain can be used. The coating fluid is placed on the surface of the carrier fluid before a curtain is formed.

The coating method of this invention is further illustrated by the following examples of its practice.

EXAMPLE 1

Using the slide curtain coating die shown in FIG. 1, a thin coating of a water soluble resin solution was applied to a polyester web. The coating fluid consisted of a solution of Carbolpol® 940 resin dissolved in tap water. This solution was prepared by first dissolving approximately 1.1% weight percent of the resin in water and then neutralizing the solution to a pH of 7 with a 5 weight percent sodium hydroxide solution. This created a viscous gel to which a saturated solution of Solvent Green 7 dye was added at a ratio of one part of dye solution per 100 parts of gel by weight. The gel was then diluted with water until a viscosity of 300 centipoise was obtained when measured at 60 rpm with a number 4 spindle on a Brookfield model LVTDV-II viscometer. To the diluted solution 0.2 gm of Silwet® 7200 surfactant per 100 gm of solution was added. The surface tension of the resin solution was 23.5 dyne/cm, and it was completely miscible with the tap water used as the second coating fluid. The interfacial tension between the first and second coating fluids to was zero because of their miscibility.

The Carbolpol® is available from the BF Goodrich Company of Cleveland, Ohio. The Solvent Green 7 dye is available from Keystone-Ingham Corporation of Mirada, Calif. The Brookfield viscometer is a product of the Brookfield Engineering Laboratories, Inc. of Stoughton, Mass. The Silwet® surfactant is manufactured by the Union Carbide Chemicals and Plastics Company, Inc. of Danbury, Conn. The polyester web was 6 inch (15.2 cm) wide, 1.4 mil (35.6 microns), Scotchpar™ polyester film purchased from 3M of St. Paul, Minn.

The second coating fluid was tap water from the municipal water supply without any surface tension modifying additives. The water was supplied at a temperature of 13° C. to a vacuum degassing vessel operated at a pressure of 200 mm of mercury absolute and then pumped to the coating die. The rate of supply was 3000 ml/min. The fluid viscosity was estimated at 1.2 centipoise. The fluid flow rate was measured both entering and leaving the vacuum degassing vessel with two identical rotometers. These were model 1307EJ27CJ1AA, 0.2 to 2.59 gpm meters purchased from the Brooks Instrument Corporation of Hatfield, Pa. The flow from the vessel was pumped by a progressive cavity pump model 2L3SSQ-AAA, Moyno™ pump of the Robbins & Meyers Corporation of Springfield, Ohio. In order to obtain a vacuum seal through this pump, it was run reverse of its normal operation. That is, its rotor was rotated opposite of the standard direction and water was pumped from the vacuum vessel through the normal Moyno™ discharge port through the pump and out from the feed opening. From the pump, the water flowed through a one-liter, sealed surge and bubble removal tank, through a fine filter, through the discharge rotometer and into the coating die. The inlet flow rate was manually adjusted by a flow throttling value at the inlet rotometer. The vacuum vessel water discharge flow rate was controlled by the speed of rotation of the Moyno™ pump and monitored by the discharge rotometer. Inlet flow rate was manually adjusted with the throttling valve to match the indicated discharge rate. The filter used was a disposable filter capsule. This was purchased from the Porous Media Corporation of St. Paul, Minn., and it was identified as part number DFC1022Y050Y, rated for 5 microns. Vacuum to the degassing vessel was supplied by a water ring vacuum pump, model MHC-25 from the Nash Engineering Corporation of Downers Grove, Ill.

During coating, the slide curtain coating die was positioned above the roll 58. More specifically, it was located so that the curtain height, h, was 3 mm and the curtain impinged on the web on the roll at an angular position 310° measured clockwise from the top of the roll. The impingement angle, $\alpha$, was approximately 45°. The die face 90 was inclined at an angle of 84° from the horizontal. The first coating fluid slot width was 18.5 cm while the second coating fluid slot width was 21 cm. The distributing slot gaps for the first and second coating fluids were 160 and 1100 microns respectively. The diameter of the coating roll 58 was 2.5 cm.

The second fluid was simultaneously drained by gravity and the excess was blown off with the air knife 54. The air knife nozzle gap was 250 microns and the compressed air was supplied to it at a pressure of 34 kilopascals.

The first coating fluid was supplied at rates of 11, 21.5, 50, and 100 gm/min. At these flow rates, a continuous falling curtain of the first fluid alone could not be produced. However, the added flow of the second coating fluid produced a stable curtain. The web speed was held constant at 29 cm/sec. It was observed that after the air knife, both the first and second fluids were present on the web. The second was present as a very thin low viscosity layer on the surface of the first fluid. A multilayer composite wet coating was created. Fluorescence of the undried coated samples was measured at 0.8, 1.4, 2.4, and 5.0 relative fluorescence units for the four first coating fluid pumping rates respectively. The coat weights as indicated by the fluorescence varied linearly with the first coating fluid pumping rate. This example illustrates that the coated thickness of the first fluid directly responds to first coating fluid pumping rate, and is not greatly affected by the use of the second fluid.

EXAMPLE 2

Using the slide curtain coating die and a second coating fluid recirculating system similar to that shown in FIG. 2, a composite coating of a water-based latex having a first fluid at high solids and a second fluid at low solids was applied to polyester web. The first coating fluid 104 consisted of Sequabond DW-1 latex with a solids content of 45% by weight. The second coating fluid 86 also consisted of the same latex with a solids composition content of 3.1% by weight prepared by dilution with de-ionized water of the high solids first fluid.

Sequabond™ DW-1 is available from Sequa Chemicals, Inc. of Chester, S.C. The polyester web was 6 inch (15.2 cm) wide, 1.4 mil (35.6 microns), Scotchpar™ polyester film purchased from the 3M Corporation of St. Paul, Minn.

The second coating fluid was pumped to the coating application die by a progressive cavity pump model 2L3SSQ-AAA, Moyno™ pump of the Robbins & Meyers Corporation of Springfield, Ohio. From the pump, the fluid flowed through a one-liter, sealed surge and bubble removal tank, through a filter and into the coating die. The filter used was a disposable filter capsule. This was purchased from the Porous Media Corporation of St. Paul, Minn., and it was identified as part number DFC1022Y050Y, rated for 50 microns.

During coating, the slide curtain coating die was positioned above roll 58. More specifically, it was located so that the curtain impinged on the web on the roll at an angular position 310° measured clockwise from the top of the roll. The impingement angle was approximately 45°. The first coating fluid slot width was 25.2 cm while the second coating fluid slot width was 25.8 cm. The distributing slot gaps for the first and second coating fluids were 254 and 500 microns respectively. The diameter of the coating roll 58 was 2.5 cm.

The second fluid was simultaneously drained by gravity and acted upon by the air knife 124 to remove a portion of the second fluid. The air knife nozzle gap was 250 microns and the compressed air was supplied to it at a pressure of 21 kilopascals. The air knife slot exit was positioned approximately 2 mm from the web surface.

The first coating fluid was supplied at a rate of 0.15 gm/sec. At these flow rates, a continuous falling curtain of the first fluid alone could not be produced. However, the added flow of the second coating fluid of 16 gm/sec produced a stable curtain. The web speed was held constant at 25 cm/sec. It was observed that after removal of excess second fluid with the air knife, both the first and second fluids were present on the web. A composite coating was accomplished. The second was present as a thin low viscosity layer on the surface of the first fluid. The dried combined coatings of first and second fluids were measured at a combined weight of 0.14 milligram/cm$^2$. At a first fluid flow rate of 4.9 gm/sec, a second fluid flow rate 30 gm/sec, a second fluid solids of 4.3%, the dried combined coating of first and second fluids were measured at a combined weight of 3.7 milligrams/cm$^2$.

I claim:

1. A method of coating a substrate with plurality of layers of coatings comprising the steps of:

moving the substrate along a path through a coating station;

metering at least one first coating fluid and a second coating fluid, wherein the first coating fluid formulation differs from the second coating fluid formulation;

forming a composite layer comprising the at least one first coating fluid and the second coating fluid;

contacting the substrate with the flowing composite layer to interpose the first coating fluid between the substrate and the second coating fluid to apply an excess of the second coating layer on the substrate; and doctoring the composite layer with a gas from a gas knife to remove some portion of the second coating layer from the substrate to produce a multiple layer composite coating on the substrate downweb of the gas knife to leave a coating comprising a plurality of distinct, superposed layers of the first and second coating fluids.

2. The method of claim 1 further comprising the step of adjusting the gas from the gas knife to remove only the second coating fluid while leaving the first coatings fluid substantially intact on the substrate by changing one of a gas knife position, a gas flow rate, and a gas velocity.

3. The method of claim 1 further comprising the steps of flowing the first coating fluid at a first flow rate that will achieve a desired dried coating weight on the substrate at a given substrate speed; and flowing the second coating fluid at a second flow rate which differs from the flow rate of the first coating fluid and which will produce a stable continuous falling curtain of the composite layer of the first and second fluids notwithstanding that the first flow rate is unable to produce a stable continuous falling curtain of the first fluid alone.

4. The method of claim 1 wherein the forming step comprises forming a composite layer comprising a plurality of first coating fluids in distinct, superposed layer and a second coating fluid.

5. The method of claim 1 wherein the metering step comprises metering first and second coating fluids which are miscible with each other.

6. The method of claim 5 wherein the forming step comprises forming a composite layer of a first coating fluid which comprises latex, and a miscible second coating fluid which comprises water.

7. The method of claim 5 wherein the forming step comprises forming a composite layer of at least one first coating fluid which comprises a first latex, and a miscible second coating fluid which comprises a second latex having a composition and percent solids, one of which differs from the first latex.

8. The method of claim 1 wherein the forming step comprises using at least one of a slide coater, a curtain coater, a jet coater, a coating bead coater, or an extrusion die coater.

9. The method of claim 1 wherein the forming step comprises forming layers of the first and second coating fluids sequentially.

10. The method of claim 1 wherein the metering step comprises metering first and second coating fluids have wetting properties that allow some of the second fluid to remain as a continuous film covering the surface of the first fluid layer after the fluid layers are applied on the substrate and after the doctoring step.

11. The method of claim 10 wherein the metering step comprises metering first and second coating fluids that are immiscible with each other.

12. The method of claim 11 wherein at least one of the first coating fluids and the second coating fluid are immiscible.

13. The method of claim 1 wherein the moving step comprises moving the substrate through the coating station at speeds of up to 1000 m/min.

14. A method of coating a substrate with plurality of layers of coatings comprising the steps of:

moving the substrate along a path through a coating station;

metering at least one first coating fluid and a second coating fluid, wherein the first coating fluid formulation differs from the second coating fluid formulation;

forming a composite layer comprising the at least one first coating fluid and the second coating fluid;

contacting a transfer surface with the flowing composite layer to interpose the second coating fluid between the transfer surface and the first coating fluid;

transferring some portion of the coating fluid to the substrate from the transfer surface to interpose the first coating fluid between the substrate and the second coating fluid to apply an excess of the second coating layer on the substrate; and doctoring the composite layer with a gas from a gas knife to remove some portion of the second coating layer from the substrate to produce a multiple layer composite coating on the substrate downweb of the gas knife to leave a coating comprising a plurality of distinct, superposed layers of the first and second coating fluids.

15. An apparatus for coating a substrate with plurality of layers of coatings comprising:

means for bringing together a first coating fluid and a second coating fluid to create a metered plurality of flowing layers of fluid in face-to-face contact with each other to form a composite layer, wherein the first coating fluid formulation differs from the second coating fluid formulation;

means for moving the substrate at a spaced distance from the means for bringing together to permit the composite layer to form a continuous flowing fluid bridge to the substrate for the coating width and to deposit the coating layer on the substrate to interpose the first coating fluid between the substrate and the second coating fluid to apply an excess of the second coating layer on the substrate; and a gas knife which doctors the composite layer with a gas to remove some portion of the second coating layer from the substrate and to produce a multiple layer composite coating on the substrate downweb of the gas knife to leave a coating comprising a plurality of distinct, superposed layers of the first and second coating fluids.

16. The apparatus of claim 15 further comprising means for adjusting the gas knife to remove only the second coating fluid while leaving the first coating fluid substantially intact on the substrate.

17. The apparatus of claim 15 wherein the means for bringing together comprises:

means for flowing the first coating fluid at a first flow rate that will achieve a desired dried coating weight on the substrate at a given substrate speed; and means for flowing the second coating fluid at a second flow rate which differs from the flow rate of the first coating fluid and which will produce a stable continuous falling curtain of the composite layer of the first and second fluids notwithstanding that the first flow rate is unable to produce a stable continuous falling curtain of the first fluid alone.

18. The apparatus of claim 15 wherein the means for bringing together comprises a die having a face, a slot communicating with the face, and a lip, wherein one of the first and second coating fluids exits from the slot onto the face and flows along the face to the lip, wherein the depositing means deposits the other of the first and second coating fluids onto the one of the first and second coating fluids while flowing along the face, and wherein the composite layer is transported along the die face to the die lip.

19. The apparatus of claim 18 wherein the die comprises one or more multilayer coating dies.

20. The apparatus of claim 15 further comprising a transfer surface on which the composite layer is deposited before being deposited on the substrate.

21. The apparatus of claim 15 wherein the composite layer comprises materials that are affected by at least one of electromagnetic radiation and electromagnetic fields.

22. The apparatus of claim 15 wherein the means for bringing together comprises metering first and second coating fluids which are miscible with each other.

23. The apparatus of claim 15 wherein the means for bringing together comprises metering first and second coating fluids have wetting properties that allow some of the second fluid to remain as a continuous film covering the surface of the first fluid layer after the fluid layers are applied on the substrate and after the doctoring step.

24. The apparatus of claim 23 wherein the means for bringing together comprises metering first and second coating fluids that are immiscible with each other.

* * * * *

UNITED STATES PATENT AND TRADEMARK OFFICE

CERTIFICATE OF CORRECTION

PATENT NO. : 5,505,995
DATED : April 9, 1996
INVENTOR(S) : William K. Leonard

It is certified that error appears in the above-indentified patent and that said Letters Patent is hereby corrected as shown below:

Col. 2, line 19, "of lo applicability" should be --of applicability--.

Col. 6, line 1, "pump 6 through" should be --pump 96 through--.

Col. 10, line 15, "first coatings fluid" should be --first coating fluid--.

Col. 10, line 29, "superposed layer" should be --superposed layers--.

Signed and Sealed this

Seventh Day of January, 1997

Bruce Lehman

*Attest:*

BRUCE LEHMAN

*Attesting Officer*

*Commissioner of Patents and Trademarks*